US009314056B2

(12) United States Patent
Skov et al.

(10) Patent No.: US 9,314,056 B2
(45) Date of Patent: Apr. 19, 2016

(54) BREATHING MASK

(75) Inventors: Roman Skov, Stuttgart (DE); Torben Skov, Tubingen (DE); Heinz Wandel, Walddort (DE); Frank Kern, Pliezhausen (DE)

(73) Assignee: Moldex-Metric, Inc., Culver City, CA (US)

( * ) Notice: Subject to any disclaimer, the term of this patent is extended or adjusted under 35 U.S.C. 154(b) by 3488 days.

(21) Appl. No.: 11/192,809

(22) Filed: Jul. 28, 2005

(65) Prior Publication Data

US 2006/0102183 A1 May 18, 2006

(30) Foreign Application Priority Data

Nov. 16, 2004 (EP) ..... 04027224

(51) Int. Cl.
*A41D 13/11* (2006.01)

(52) U.S. Cl.
CPC ..... *A41D 13/1146* (2013.01)

(58) Field of Classification Search
USPC ..... 128/206.12, 206.13, 206.16, 206.19, 128/206.21, 206.23, 206.24, 206.27, 128/206.28, 205.25, 205.29
See application file for complete search history.

(56) References Cited

U.S. PATENT DOCUMENTS 3,971,369 A * 7/1976 Aspelin et al. ..... 128/206.19
4,248,220 A * 2/1981 White ..... 128/206.19
4,419,994 A * 12/1983 Hilton ..... 128/206.19

* cited by examiner

*Primary Examiner* — Ophelia A Hawthorne
(74) *Attorney, Agent, or Firm* — Charles H. Schwartz

(57) ABSTRACT

A foldable breathing mask formed with a deep-drawn mask body and sufficiently rigid so as to retain its shape and including at least one fold line for a storage folding of the mask body is a predefined manner.

13 Claims, 4 Drawing Sheets

BREATHING MASK

BACKGROUND OF THE INVENTION

The invention relates to a breathing mask of the with a deep-drawn mask body rigid so as to retain its shape, characterized by at least one predefined fold line on the mask body for folding for storage. A preferred process for the manufacture of the folding type mask is characterized in that first and the second fold lines run crosswise to one another. Specifically, a first and at least a second fold line each with a predefined folding direction for first and a second storage folding are embossed in the mask body. The first fold line extends centrally between side areas of the mask body from an outer edge in a chin area over a partial length in the direction of a nose area of the mask body. The second fold line runs from an outer edge in one side area to the outer edge in the opposite side area crosswise to the first fold line, whereby the first fold line ends on or near the second fold line.

A breathing mask, a process and a form of this type are known from DE 27 17 968. This publication describes a disposable breathing mask with a mask body rigid so as to retain its shape, which is manufactured in a mould with a die by means of deep drawing. Mask bodies which are rigid so as to retain their shape are very advantageous in use, as they create a breathing hollow in front of the mouth and nose of the user which does not collapse even during inhalation, i.e. the mask body is not sucked against the nose and mouth by the pull of inhalation, further inhalation is not hindered and the user is not annoyed or inconvenienced. Mask bodies which are rigid so as to retain their shape are, however, more difficult to store when not in use. The mask body is usually not so rigid that it cannot be squeezed up in order to be placed in a pocket of a piece of clothing. However, the fact that it retains its shape means that it constantly attempts to return to its original form, which means that it jams in the pocket, making subsequent removal from the pocket difficult.

SUMMARY OF THE INVENTION

The invention is based on the task of creating a breathing mask, which can be easily stored.

This task is fulfilled by means of at least one predefined fold line on the mask body for folding for storage.

The folding line according to the invention means that the mask body, which is rigid so as to retain its shape can be folded for storage. The predefined fold line ensures that the force needed to return to the original shape is reduced without reduction of rigidity, in particular, as regards the pressure of inhalation, or with only a slight reduction in rigidity.

Foldable breathing masks are known, for example from WO-A-00 48 481 or EP-A-1 147 787; however, these breathing masks do not include a mask body, which is rigid so as to retain its shape, but are manufactured of one or several flat sections of one-piece material, whereby the folding lines are predefined by means of joining seams or darts.

Further advantageous developments of the invention are described as follows.

Embossed fold lines are on the one hand easy to manufacture and on the other hand can still be used after the mask has been folded and unfolded several times.

It is useful to create the fold line for a predefined folding direction, so that the user automatically finds the most favorable way of folding the breathing mask so as to save space.

The fold direction can be defined by a certain form of the fold line, preferably by making the fold line wider and/or deeper at the inside of the storage fold than on the outside.

If the mask body is supplied with a stiffened outer edge, folding is made easier if a fold line, which extends to the outer edge ends in a notch at said edge.

A stabilizing embossed pattern and/or a sealing lip in the nose area stabilizes the mask shape after folding.

It is useful to fix the storage folding in the folded condition, which can preferably be achieved by providing the fold line in an area of the mask body, which is domed outwards and locating the inside of the storage folding on the outside of the domed area. When the mask is folded together, the domed area must then be pressed to the inside, which achieves a certain fixing of the folding. On the other hand, it is sufficient to unfold the mask body if light pressure is applied on the outside of the storage folding (i.e. the inside of the domed area), in order that the domed area springs back to its original form and recreates the original form of the mask body. At the same time, the rigidity of the mask body against the pull during inhalation is also maintained in the area of the fold line. This effect is increased if the fold line is provided in a part of the mask body which can be shaped and which retains its shape.

For a preferred quarter folding of the mask body, basically two fold lines with different folding directions are sufficient, whereby one fold line extends between two side areas, i.e. parallel to the mouth, and the other fold line basically runs at right angles to this and only extends over a partial area between opposite outer sides, preferably extending over the chin area.

The mask body of the breathing mask according to the invention is preferably deep-drawn, whereby this process has the advantage that the fold line can be formed in at the same time.

In order to form in the fold lines, a mould is preferably used in which corresponding ribs are provided on the hollow section of the mould and on the die.

BRIEF DESCRIPTION OF THE DRAWINGS

Embodiments of the invention are described in more detail by reference to the drawings, which are as follows.

DETAILED DESCRIPTION OF THE PREFERRED EMBODIMENTS

Figure 1:
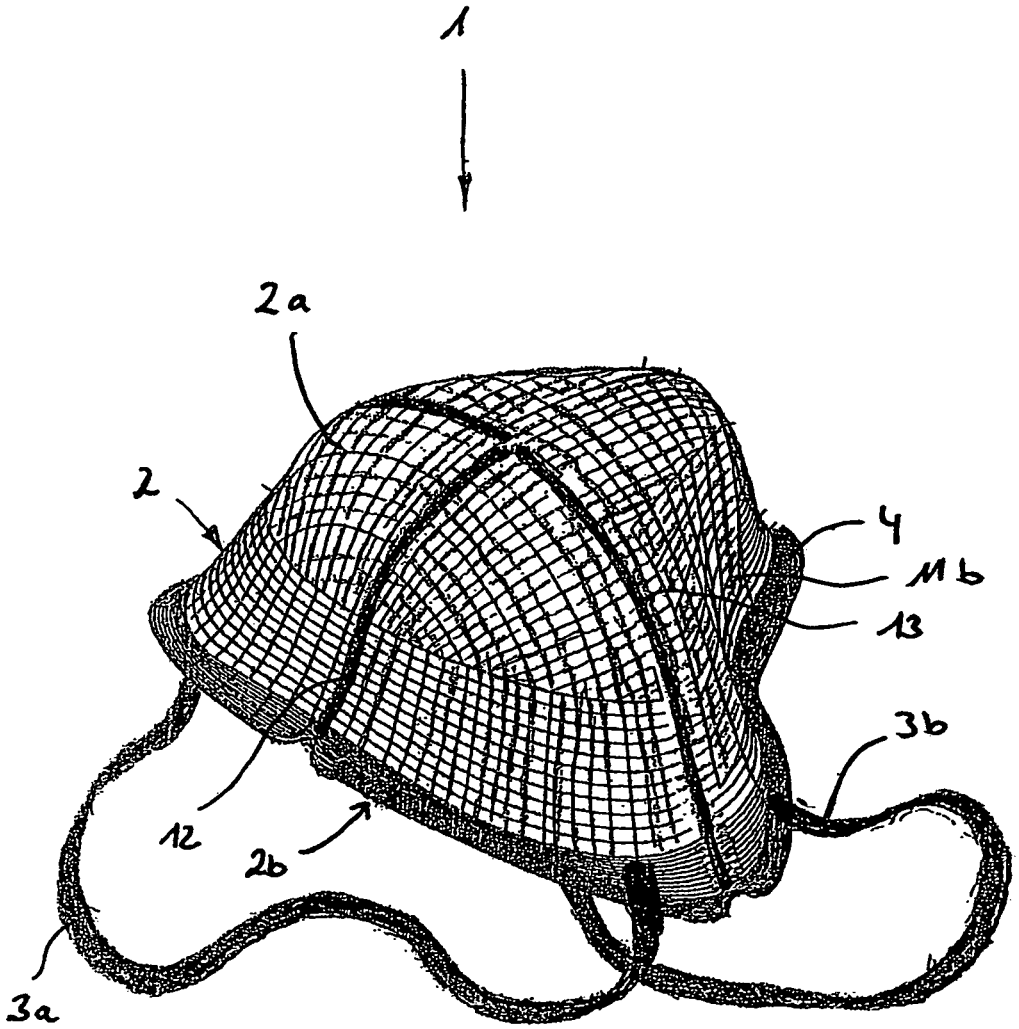
FIG. 1 a breathing mask according to the invention in perspective view.

FIG. 1 shows a perspective, schematic view of an embodiment of a breathing mask 1 according to the invention, with a mask body 2 and two head straps 3*a*, 3*b*. Breathing mask 1 can also exhibit a known type of exhalation valve, not shown, a nose clip or other components found in traditional breathing masks.

Mask body 2 of breathing mask 1 is of the usual pre-formed type it is rigid so as to retain its shape and is fully shaped. The concept "rigid so as to retain its shape" means that mask body 2 retains its shape even against the pull, which is created during inhalation, i.e. it does not collapse during this process. Nevertheless, the mask body can preferably be deformed, however, only under the influence of forces, which exceed the forces, which normally occur during the inhalation. This means that the mask body can be compressed without difficulty. The concept also includes a certain elasticity as regards the shape, which means that mask body 2 attempts to regain its original shape after deformation. The concept "fully-formed" means that the shape of the mask body was achieved by forming, and not by cutting and combining sections of flat material, although of course the mask body can also be composed of different sections which are each individually fully formed.

Full forming of the mask body is preferably achieved by means of deep drawing, whereby the entire material of mask body 2 is pressed into a hollow space that defines the outer contour of mask body 2 by means of a die that defines the inner contour of mask body 2 under the influence of pressure and heat. A circumferential outer edge 4 is simultaneously created during this process, which is shaped in such a way that it lies against the mouth and nose of the wearer so as to form a seal.

The material of mask body 2 preferably consists of several layers and contains at least one formable and form-retaining layer. In the embodiment shown, the mask body, as shown in exaggerated form in FIG. 3, consists of a form-retaining and formable layer 5 as well as a filter layer 6 that does not necessarily have to be formable and form-able and form retaining. In the illustrated embodiment, layer 5 consists of a mesh of thermoplastic material or similar, whose mesh size is considerably coarser than that of filter material 6, so that the passage of air is hindered as little as possible. However, the material of layer 5 can be heat-welded, can be easily formed under the influence of heat and pressure and then sets in the assumed shape. The mesh construction and the material itself continues to allow the mask body a certain elasticity as regards its shape and therefore continues to try to return to the shape given to the mask during the forming process even after application of outside force, as soon as the outside force decreases.

Mask body 2 has the usual beaker or bowl shape, with an outer side 2*a* preferably consisting of layer 5 and an inner side 2*b*, turned towards the user. The shape of mask body 2 includes a nose area 7, i.e. an area which extends over and on both sides of the nose of a user, a chin area 8, which extends under the chin of the user and left and right side areas 91 and 9*b* which connect nose area 7 and chin area 8 with each other, which project backwards towards the ears of the user and which are provided with head straps 3*a*, 3*b*.

On the inner side 2*b* of mask body 2 a sealing lip 10 is provided in nose area 7, which extends over the entire nose area 7, i.e. forming a seal over the area over the bridge of the nose of the user and next to the wings of the nose. Sealing lip 10 is preferably fixed or formed onto the mask body during manufacture of the mask body and consists of a soft, yielding sealing material, such as for example a foam material.

In nose area 7, two stabilization areas 11*a* and 11*b* are provided which are formed as slight hollows or depressions and which lead to mask body 2 lying more firmly against the wings of the nose of the user, whereby the area of the mask body allocated to the bridge of the nose of the user becomes narrower and therefore exhibits a better fit on the user's nose.

Mask body 2 of the breathing mask 1 according to the invention can be folded up for storage purposes, for example in a pocket of an item of clothing. For this purpose, the mask body 2 includes at least one predetermined folding line. The folding line is preferably embossed in mask body 2, which usefully occurs during manufacture of mask body 2. If mask body 2 is deep-drawn, this can be carried out during the deep-drawing process, whereby a mould is used which exhibits a mould cavity and a die. In order to emboss the fold line, at least one rib is provided which projects into the cavity of the mould, whereby however preferably two corresponding mould ribs are used for each fold line, of which one is allocated to the die.

In the embodiment, which is shown, the breathing mask 1 is designed for folding into quarters, for which basically two fold lines 12, 13 are responsible.

The first fold line 12 extends in a straight line and centrally between the two side areas 9*a* and 9*b* of outer edge 4 in the chin area 8 in the direction of the outer edge 4 in nose area 7, however only over a partial length of the distance between chin area 8 and nose area 7. The partial length comprises half or less than half of this distance. The first fold line 12 opens at outer edge 4 in chin area 8 in a notch 14, which breaks through outer edge 4 and ensures that the somewhat stiffer outer edge 4 does not hinder folding.

Figure 3:
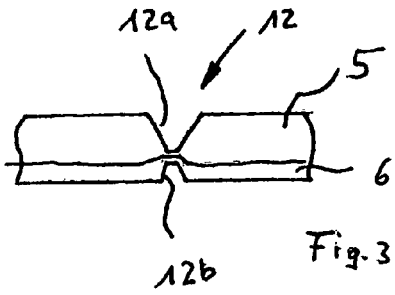
FIG. 3 section 111-11*f* from FIG. 2.

As the cross-section through the fold line in FIG. 3 shows, fold line 12 is formed of two partial lines 12*a* and 12*b*, where by partial line 12*a* is deeper and/or wider than partial line 12*b*. However, both partial lines 12*a*, 12*b* are arranged so as to run in the same path and on top of one another. Partial lines 12*a*, 12*b* are here basically in the form of triangular or trapezoid line indentations, whose points are directed towards one another. The preferred fold direction around fold line 12 is predefined. This is achieved in the illustrated embodiment by means of the different sizes of the two partial lines 12*a*, 12*b*, whereby the wider and/or deeper partial line 12*a* comes to lie on the inner side of a first storage folding 15 (FIG. 5) as because of the deeper and/or wider partial line 12*a* it is possible to lay the areas of the mask body to be folded more closely on one another. The inner side of a storage folding is therefore defined as the side on which the areas to be folded lie on one another.

Figure 5:
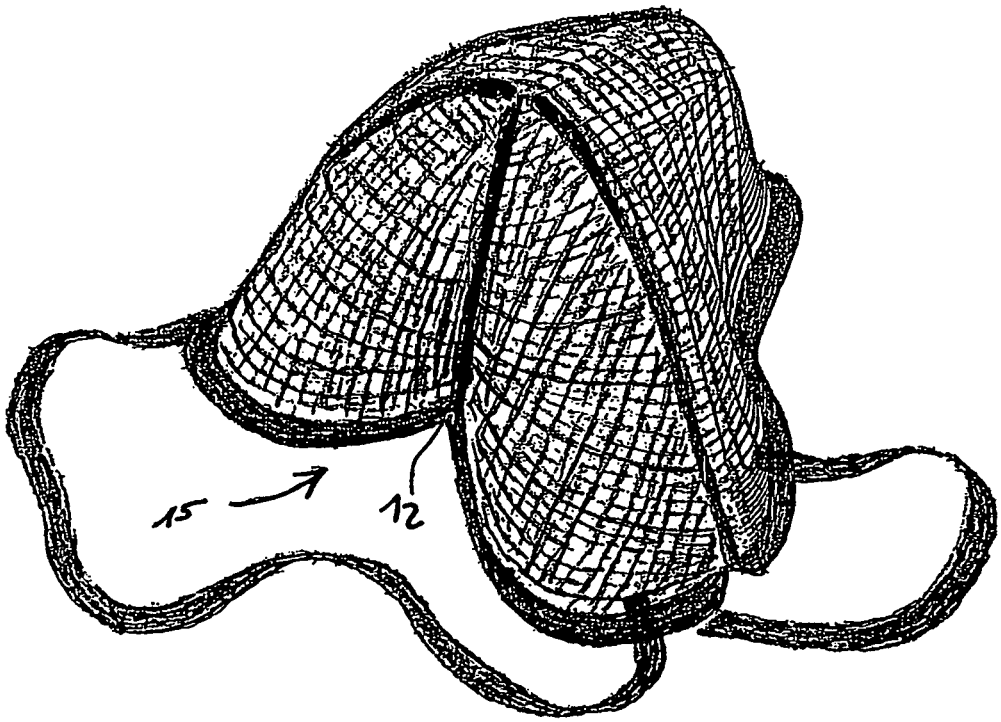
Figure 6:
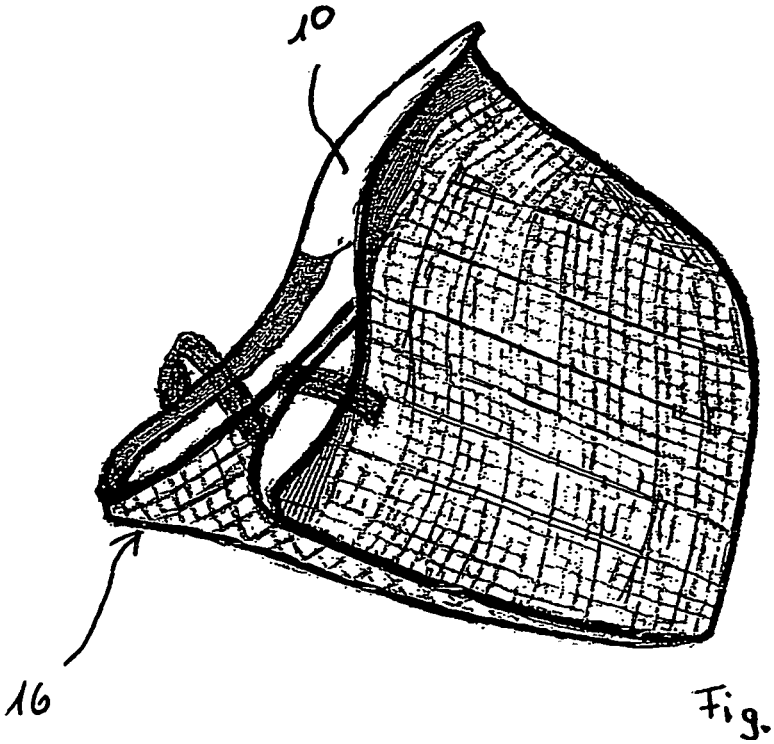

In the illustrated embodiment, the fold direction of the first fold line 12 is predefined in such a way that it, as FIGS. 5 and 6 show, can be folded into the inside of the mask body. This means that the inner side of the first storage folding 15 is on the outer side 2*a* is embossed into the outside surface 2*a* of mask body 2 and in particular into the thicker outer layer 5.

The first fold line 12 continues to e found in a section of mask body 2 which is bent to the outside and runs over this bent section, i.e. fold line 12 is also bent to the outside. In order to create storage folding 15 directed towards the inside, therefore, first fold line 12 has to be straightened by pressure from outside on fold line 12, before folding is possible. This ensures that mask body 2 does not fold together of its own volition through inhalation pressure. Furthermore, fixing of the first storage folding 15 in the folded condition is also achieved, as in order to unfold mask body 2 additional inner pressure must be exerted on fold line 12 din order to return this to the shape bent to the outside.

For the desired quarter folding (FIG. 6), fold line 13 is provided, which basically extends vertically to first folding line 12 from a notch 14 in outer edge 4 in a side area 9*a*, to a further notch 14 in the outer edge 4 in the other side area 9*b*, whereby fold line 13 ends respectively between the two head straps 3*a*, 3*b*. The second fold line 13 basically forms a T shape with the first fold line 12, whereby the first fold line 12 reaches up to the second fold line 13 or ends in its immediate vicinity.

The second fold line 13 can be in the form of a continuous line or can be formed of two separate fold lines, which each run from the allocated side area 9*a* or 9*b* to the first fold line 12.

The fold direction is also predefined for the second fold line 13. However, this runs opposite to the folding direction of the first folding direction 12, i.e. the deeper and/or wider partial line of fold line 13, not illustrated here, is located on the inner side 2*b* of mask body 2 and reaches into the outside layer 5, while the narrower or shallower partial line of fold line 13 is located on outer side 2*a*. Otherwise, fold line 13 is designed in the same way as fold line 12.

As shown in FIGS. 5 and 6, a second storage folding 16 is formed by second fold line 13, which allows the mask body to be folded together to approximately a quarter of its size, whereby chin area 8 is folded into the inside of mask body 2 into nose area 7.

Figure 2:
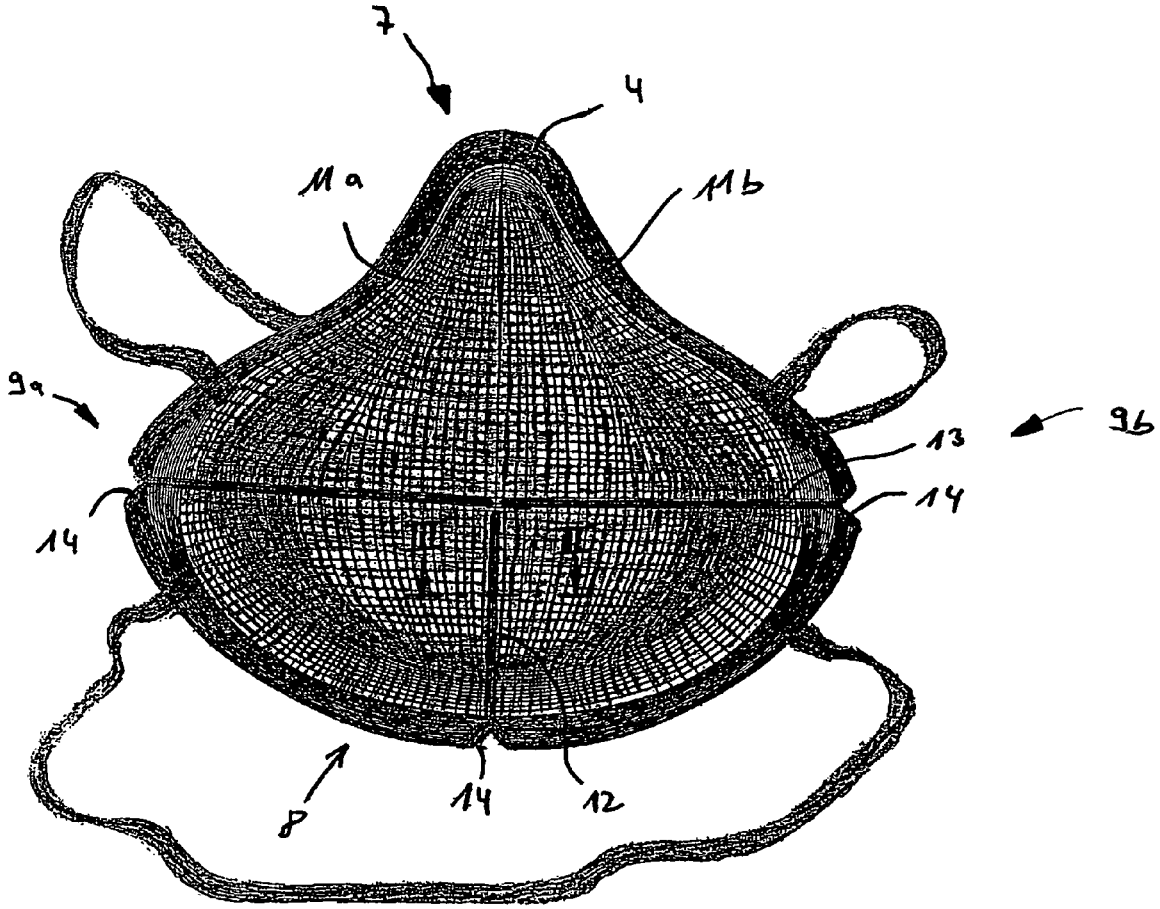
FIG. 2 front view of the breathing mask according to FIG. 1.
Figure 4:
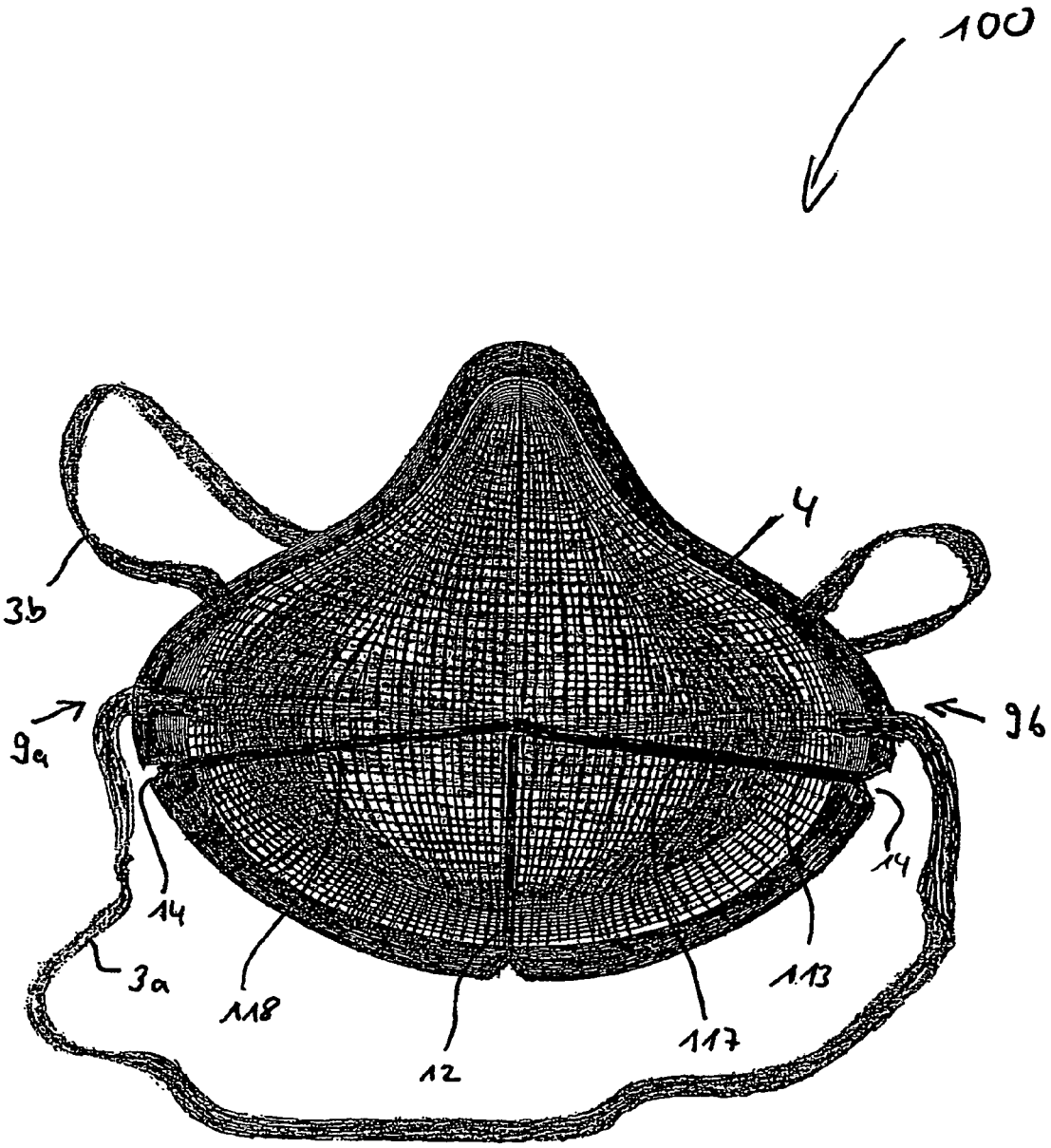
FIG. 4 a further embodiment of a breathing mask according to the invention in front view, FIG. 5 the breathing mask according to FIG. 1 during folding, and FIG. 6 the breathing mask according to FIG. 1 in folded condition.

FIG. 4 shows a further embodiment of a breathing mask 100 according to the invention, which only differs from the embodiment of FIGS. 1 and 2 because of the arrangement of the two head straps 3*a* and 3*b* as well as a second fold line 113 which exhibits a different path. All other characteristics correspond to the characteristics of the embodiment, so that the description referring to the latter also applies.

The second fold line 113 does not extend in breathing mask 100 at right angles to the first fold line 12, but forms together with this a shape which is almost that of an arrow, whereby fold line 113 consists of two sections 117 and 118, which each extend from the end area of the first fold line 12 in an acute angle to the first fold line 12 in the direction of the respectively adjacent side areas 9*a* and 9*b* and there again end in a notch 14 in outer edge 4. This arrangement creates space for the attachment of both head straps 3*a*, 3*b* and above the second fold line 113, so that the head straps can be located at a position which is favorable for attachment to the head of a wearer, but do not disturb the folding.

As a modification of the embodiments described in the test and illustrated in the drawings, the mask body can also be manufactured in a different way. Quarter folding of the mask body is preferred; however the mask body can be folded even smaller or only by half, if this is more useful. The first fold line need not necessarily begin at the chin area, but can also extend from the nose area or, similarly to the second fold line 13, run from the chin to the nose area. It is also possible to change the arrangement, the function and the relationship of the fold lines to one another. For example, one fold line with a fixed folding direction, where in the inner side of the fold lies on the inner side of mask body 5, in other words in the same way as the second fold line of the embodiments described here, runs from the chin area to the nose area, while a further fold line, in which the fold direction is defined in such a way that the inner side of the folding lies on the outer side of the mask body, runs from a side area through a partial length of the distance in direction of the other side area. The embodiment described here can also be used with breathing masks, which are supplied with an exhalation valve. Also, the design according to the invention is not limited to the construction and shape of the mask body described here, and can include several filter layers as well as additional layers or filter material with different filter effects. Attachment to the head of the wearer can also be implemented in a different manner from that which is shown.

Although the invention has been shown with reference to specific embodiments, it will be appreciated that various adaptations and modifications may be made and that the invention is only to be limited by the appended claims.

We claim:

1. A breathing mask molded to form a deep-drawn mask body that is sufficiently rigid so as to retain its shape without any additional structural elements, including at least one predefined fold line on the mask body for providing a storage folding of the breathing mask, a first and at least a second fold line provided for a first and a second storage folding and with an inner side of one storage folding lying on the outside of the mask body and the inner side of the other storage folding lying on the inner side of the mask body, and wherein the first and the second fold lines run crosswise to one another.

2. The breathing mask according to claim 1, wherein the fold lines are embossed.

3. The breathing mask according to claim 1, wherein the fold lines are formed for a predefined folding direction.

4. The breathing mask according to claim 1, wherein the fold lines are deeper and/or wider on the inner side of the storage folding than on an outer side of the storage folding.

5. The breathing mask according to claim 1, wherein the mask body is provided with an outer edge and the fold lines end in a notch in the outer edge.

6. The breathing mask according to claim 1, wherein the mask body includes a nose area and the mask body is provided with a stabilizing embossed pattern in the nose area.

7. The breathing mask according to claim 1, wherein the mask body includes a nose area and the mask body is provided with a sealing lip in nose area.

8. The breathing mask according to claim 1, wherein the storage folding is fixed.

9. The breathing mask according to claim 1, wherein the mask body includes an area that is domed outward and the fold lines are provided in the area of the mask body that is domed outwards and that the inner side of the storage folding is located on the outer side of the domed area.

10. The breathing mask according to claim 1, wherein the mask body includes at least one formable and form retaining layer and that the fold lines are provided in this form-retaining layer.

11. The breathing mask according to claim 1, wherein the mask body includes two side areas and the fold lines are basically located centrally between the two side areas of mask body and only extends from an outer edge of the mask body over a partial length of the distance to an opposite outer edge of the mask body.

12. The breathing mask according to claim 1, wherein the mask body includes a nose and a chin area and the fold lines are basically located centrally between the nose and a chin area of the mask body and extends from a side outer edge of the mask body to the opposite side outer edge of the mask body.

13. The breathing mask according to claim 1, wherein the mask body includes the first and at least the second fold line with predefined folding directions for a first and a second storage folding and wherein the fold lines are embossed in the mask body so that the first fold line basically extends centrally between side areas of the mask body from an outer edge of the mask body in a chin area over a partial length in a direction of a nose area of the mask body, whereby the inner side of the first storage folding lies on the outer side of the mask body, and wherein the second fold line runs from outer edge in a side area of the mask body to the outer edge in the opposite side area of the mask whereby the first fold line ends on or near the second fold line.

* * * * *